US006436205B1

(12) United States Patent
Behrens et al.

(10) Patent No.: US 6,436,205 B1
(45) Date of Patent: Aug. 20, 2002

(54) METHOD FOR SURFACE PROCESSING OF A CONTINUOUSLY CAST STEEL PRODUCT AND DEVICE THEREFOR

(75) Inventors: Holger Behrens, Erkrath; Hans Georg Hartung, Pulheim; Günter Kneppe, Hilchenbach, all of (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 09/704,220

(22) Filed: Nov. 1, 2000

(30) Foreign Application Priority Data

Nov. 4, 1999 (DE) ..... 199 53 252

(51) Int. Cl.[7] ..... B22D 11/00

(52) U.S. Cl. ..... 148/541; 148/508; 148/644; 266/259; 164/476; 164/477

(58) Field of Search ..... 148/508, 541, 148/579, 639, 644, 660, 661; 266/259; 72/39, 40; 164/476, 477

(56) References Cited

U.S. PATENT DOCUMENTS 6,184,924 B1 * 2/2001 Schneider et al. ..... 348/92

FOREIGN PATENT DOCUMENTS

DE 3037571 4/1982

EP 0435897 4/1994

* cited by examiner

*Primary Examiner*—Deborah Yee
(74) *Attorney, Agent, or Firm*—Friedrich Kueffner

(57) ABSTRACT

In a surface processing method for removing surface flaws, surface contaminants, and the like from a continuously cast metal product in a hot state, at least a portion of at least one metal product surface is cooled for a defined temperature decrease of a surface to be treated and a surface treatment is then performed. The device therefor has a cooling device for cooling at least a portion of at least one metal product surface for a defined temperature decrease of a surface to be treated and a surface treatment device downstream of the cooling device in the product conveying direction. The production arrangement for this has a continuous slab casting device, a heating arrangement with at least one of a heating device and a temperature equilibration device arranged downstream of the casting device. A hot mill train is arranged downstream of the heating arrangement in the conveying direction. The surface processing device for removing surface flaws, has a device for cooling at least a portion of at least one metal product surface for a defined temperature decrease of a surface to be treated and a surface treatment device downstream of the cooling device in the product conveying direction. The surface processing device is arranged between the casting device and the hot mill train.

20 Claims, 3 Drawing Sheets

METHOD FOR SURFACE PROCESSING OF A CONTINUOUSLY CAST STEEL PRODUCT AND DEVICE THEREFOR

BACKGROUND OF THE INVENTION

1. Field of the Invention

The invention relates to a method for surface processing of a continuously cast steel product in the hot state for the removal of surface flaws, surface contaminants etc. Moreover, the invention relates to a device therefore, as well as an arrangement for manufacturing strips and sheets with a device for surface treatment integrated in the process. In the context of this invention the cast product is not limited to a certain thickness or geometry.

2. Description of the Related Art

Basically, the surface processing of sheets and strips of steel after rolling in the cold state is known, for example, by pickling. During solidification of continuous cast products, especially products of stainless steel alloys or acid-resistant steel alloys or RAH (rust, acid and heat resistant) qualities, an outer skin is however formed which, on the one hand, can have geometric surface flaws or markings and, on the other hand, can contain contaminants of segregation, oxides, and casting powder residues. It is therefore desirable to remove these before rolling in order to satisfy highest product requirements of the surface properties of the rolled strips and sheets.

From EP 0 435 897 B1 a method for grinding ingots, slab, or similar workpieces of metal is known in which surface flaws or surface contaminants are removed in the hot state. Advantages of these preceding grinding processes performed in the hot state, i.e., in direct connection with casting, continuous casting, rolling, or a different type of hot forming, is that the material is ground before scaling can occur on the surface due to cooling which must be removed in the cold state in addition to the surface flaws. A certain temperature interval for employing grinding methods is indicated whose lowest limit value is the temperature at which essentially a scaling layer is not yet formed. The upper limit value is determined by the composition of the grinding belt, i.e., by the highest temperature at which the strip is not thermally disadvantageously affected. It is suggested to increase the service life of the grinding belt by increasing the rotational speed. Even though, the use of the grinding belt is limited to the provided temperature interval. Moreover, despite increase of the rotational speed it cannot be excluded that the belt, due to the high temperatures of the product to be ground and due to the resulting frictional energies, will melt or burn. The disadvantageous consequences are smudging or residues of the damaged belt on the metal surface.

From DE 30 37 571 A1 a method for mechanical removal of material from continuous cast surfaces in the hot state is also known wherein the hot strand, before being transversely cut, is ground with grinding wheels moving back and forth between the strand edges simultaneously on the top surface and bottom surface. The grinding wheel however does not reach a long service life.

SUMMARY OF THE INVENTION

It is an object of the present invention to provide a method and a device with which a surface processing of continuously cast steel products for removal of surface flaws in the hot state can be achieved by using surface processing devices not necessarily adjusted to high temperatures while achieving a long service life.

In accordance with the present invention, this is achieved in that, prior to the step of surface treatment, a cooling of at least a part of at least one surface of the metal product is performed for a defined temperature reduction of the surface to be processed. The suggested device accordingly provides a corresponding cooling means.

As a consequence of the step according to the invention of a partial cooling, i.e., a surface near cooling, the processing tools for surface treatment are thermally less loaded than in the methods according to the prior art. It is even possible to employ temperature sensitive processing methods and such methods that are not designed for high temperatures because, due to the preceding partial temperature reduction, the service life of the tools, for example, grinding belts or grinding wheels, is increased. A disadvantageous decomposition of the grinding belt with smudging of the residues on the metal surfaces or bursting of the grinding wheels does not occur.

The directed temperature reduction is therefore limited to the surface of the metal product and advantageously adjusted such that the processing resistance of the workpiece is not influenced in an undesirable fashion. According to the inventive method, all surfaces of the metal product, for example, of a thin slab portion, i.e., the underside and top side as well as the lateral surfaces, can be cooled. However, it is also conceivable that only one surface, for example, only the top surface of the metallic product is cooled or only defined portions of surfaces.

According to the suggested method surface treatments of all types, geometries, and thicknesses of cast products are conceivable, and the method is not limited to the use of slabs or thin slabs for producing sheets and strips.

According to a preferred embodiment is suggested that the steps of surface cooling and surface processing is preceded by an inspection of at least one portion of the surface of the metallic product with respect to surface flaws or contaminants and, based on the result of the inspection, a selective surface processing only of the surface areas which have been detected as having a flaw takes place. As with the partial cooling, the inspection can be performed on all surfaces or only on portions thereof. The subsequent partial cooling of the surface is carried out preferably continuously, but conceivable is also a cooling action limited to the areas which have been found to have flaws which requires a corresponding operative excess expenditure and a subsequent consideration of the temperature differences within the surface.

According to a further preferred embodiment, it is suggested that a cleaning or descaling process is performed directly upstream of the surface processing arrangement with the step sequence of surface inspection, partial cooling of the surfaces, as well as surface treatment. By means of the descaling process an additional cooling action results, and, moreover, possibly already formed scaling or surface contaminants already present are removed and a suitable basis for the inspection of the surface is provided.

Overall, all known methods for surface treatment can be employed, such as, for example, grinding, milling, or flame chipping. In particular, grinding can be employed with use of known tools such as grinding belts, grinding wheels, or grinding stones with different type of grains and grain size.

In the known embodiments it is possible to process the underside and top side and/or the lateral surfaces of the cast product that is, for example, in the form of slab or thin slab, simultaneously as well as successively. For a simultaneous treatment, the processing time is reduced and the energy expenditure is kept at a low level, in particular, since the surface removal is carried out in the hot state in which the removal can be performed with a reduced energy expenditure in comparison to the cold state.

Preferably, the surface treatment on the partially cooled surfaces, together with the preferably suggested preparative method steps, is carried out for the continuously cast steel product preferably between the casting process and the—preferably directly successively performed—rolling process. The surface treatment is either integrated inline in this production line (X) or is carried out offline in a branch line (Y).

Different embodiments of the surface processing devices or arrangements result from the different compositions of individual devices (cooling device—inspection device—cleaning device) as well as in the case of a direct casting and rolling method from the different sequences of the buffering, compensation, or heating furnaces in an inline or offline version. For example, a device for cooling at least one part of at least one surface of the metal product is arranged upstream of the device for surface treatment of the metal product.

Preferably, the cooling device has an inspection device for detection of flawed surface areas arranged upstream thereof.

The inspection device may have a cleaning device, preferably a descaling device, arranged upstream thereof.

The arrangement for producing sheets and strips of metal comprises a continuous casting device for casting slabs, preferably of a thickness between 30 and 250 mm, optionally a transverse separating device, a heating arrangement of a heating device and/or a temperature compensation device, a hot mill train, as well as a device for surface processing as explained above.

The surface processing device is arranged upstream and/or downstream of the heating device and/or a temperature compensation device in the conveying direction of the slab within the production line.

The arrangement comprises a branch line, arranged parallel to the heating device and/or a temperature compensation device or portions thereof, and slab portion carriages configured to move the slab portions from the production line to the branch line and back, wherein the slab portion carriages are arranged before and behind the heating device and/or a temperature compensation device or portions thereof.

The branch line further comprises a temperature equilibration furnace or a heating furnace downstream of the surface treatment device.

Preferably, a buffer furnace is arranged upstream of the surface treatment device.

The method according to the invention is preferably used for surface processing of rust-resistant (stainless) and acid-resistant steel products.

DESCRIPTION OF THE PREFERRED EMBODIMENTS

Figure 1:
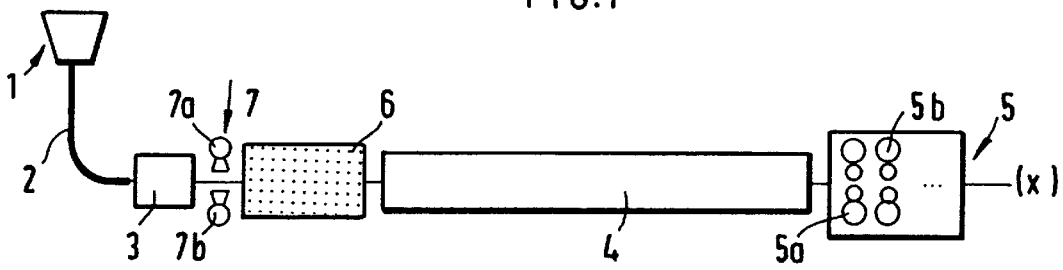
FIG. 1 is a side view of a device for manufacturing strips and sheets with the step of partial cooling arranged upstream of the surface processing within the production line (X)

According to FIG. 1, the arrangement for producing steel sheet and strips, especially of rust-resistant (stainless) and acid-resistant steels, is substantially comprised of a continuous casting device 1 (here schematically illustrated by a casting mold) for a strand 2 of 30 to 250 mm thickness, preferably of 30 to 130, wherein these thickness data do not limited the scope of the invention, a transverse separating device 3, a device 4 for heating or compensating the temperature, for example, a walking beam furnace or a roller hearth furnace, as well as a mill train 5 (schematically indicated by two roll stands 5*a*, 5*b*). The details of the mill train (cogging stand, coil box etc.) and the cooling device as well as coiling device arranged downstream of the mill train 5 are not illustrated. Depending of the type of embodiment, the separating device can be eliminated.

After deflection into the horizontal direction by the transverse separating device 3, preferably in the form of transverse cutting shears, the cast slab strip 2 is divided into portions and transported through the furnace 4. The slab portions which are heated or thermally compensated in the furnace 4 to a homogenous rolling temperature, are subsequently rolled to strips in the mill train 5 in the illustrated embodiment. In the following, this sequence of steps will be referred to as production line (X).

Between the transverse separating device 3 and the furnace 4, a device for surface treatment 6 in the hot state of the respective slab portion is arranged. The type of surface treatment is not specified in more detail in this connection; for example, it can be a known method of grinding with grinding belts, grinding wheels, or grinding stones or milling. In this embodiment, the slab transport speed during the surface treatment corresponds approximately to the casting speed. A device for partial cooling 7 is arranged upstream of the device for surface treatment 6, when viewed in the conveying direction. According to the illustrated embodiment, the top side as well as the bottom side of the respective slab portion are cooled simultaneously in a defined partial area by means of a two-part cooling device (parts 7*a*, 7*b*), for example, by means of jets that apply a cooling medium onto the surface.

Coming from the casting heat, the core temperature of the slab remains substantially unaffected by the partial cooling action while in the cooled surface area a fast temperature drop occurs. In the core area, only a slow steady temperature drop as a result of the overall thermal conditions, i.e., the cooling after the casting process, is to be observed. Depending on the intensity of cooling, the surface temperature of the slab drops to a temperature below 900° C., preferably to a temperature interval between 500 to 900° C. This is advantageous with respect to the service life of the employed tools for a cutting surface processing. After completion of the surface treatment, a homogenization of the temperatures or of the grain structure across the slab cross-section is ensured in the furnace 4. In the case of rust-resistant (stainless) and acid-resistant austenites, which do not convert upon cooling, a partial cooling of the surface or parts of the surface is not a problem, not even to low temperatures.

In the devices illustrated in the additional Figures, components which correspond to those in FIG. 1 are identified with identical reference numerals. In contrast to the device according to FIG. 1, in the device according to FIG. 2 the processing means 6 has arranged upstream thereof a device for surface inspection 8 in addition to the device for surface cooling 7. It is comprised also of two components 8*a*, 8*b* in order to record the top side and bottom side of the slabs 2 continuously across a defined portion upon their passing through and to detect possibly present surface flaws. As a function of the inspection result, respectively, of the stored data in regard to the amount and the position of surface flaws etc., in the subsequently arranged surface treatment processing device 6 only a selective surface treatment is performed automatically in that, for example, the grinding means engage only locally on the slab surfaces. Such an inspection is performed with known types of surface analysis devices which sense the surface according to a grid pattern or according to portions thereof.

In the method variant with integrated inspection device 8 or surface analysis, it may be advantageous to clean the surfaces of the slab before the inspection in order to make the surface flaws easier to detect. According to FIG. 3, one embodiment is shown which comprises a descaling device 9 comprised of two components (9*a*, 9*b*) for simultaneously affecting the top and bottom surfaces of the slab 2. Also, it is conceivable to successively process the top side and the bottom side or the lateral sides by correspondingly staggered devices. The descaling device 9, when viewed in the conveying direction, is arranged upstream of the inspection device 8 and the latter again is arranged upstream of the device for partial cooling 7.

Figure 2:
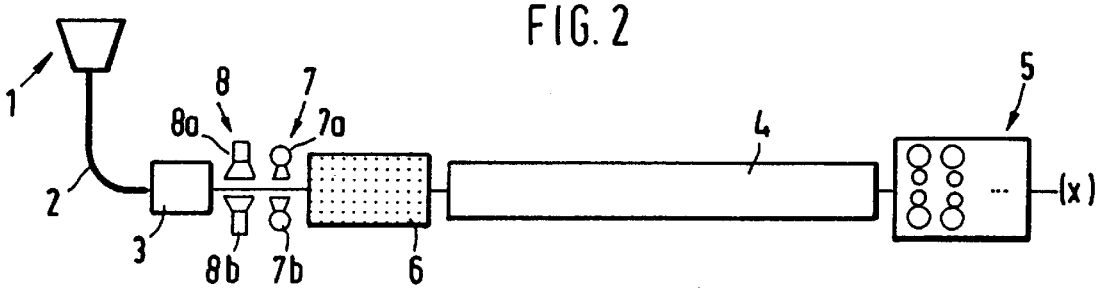
FIG. 2 is a first embodiment of the device according to FIG. 1 with the step of surface inspection arranged upstream of the surface processing within the production line (X)
Figure 3:
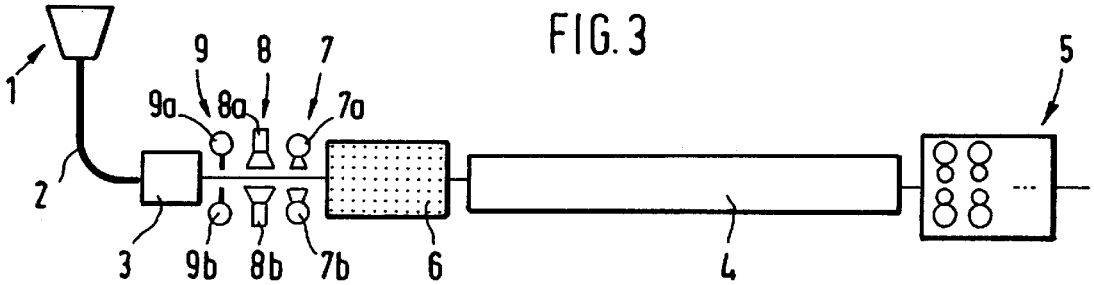
FIG. 3 is a second embodiment of the device according to FIG. 2.

In addition to the inline versions illustrated in FIGS. 1 through 3, i.e., the surface processing device 6 is arranged within the production line (X), the FIGS. 4 through 7 illustrate embodiments of a so-called offline version.

Figure 4:
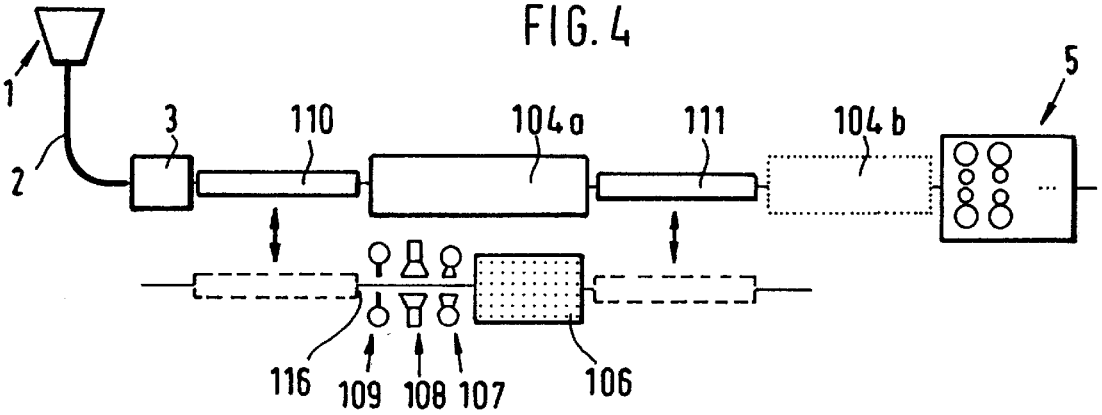
FIG. 4 is a side view of a device for producing strips and sheets with a surface treatment performed in a branch line (Y)

According to FIG. 4, the arrangement has a production line (X) comprised of a continuous slab casting device 1, a transverse separating device 3, a transversely movable first carriage 110, a first portion of the furnace 104*a*, a second transversely movable carriage 111, optionally a second furnace part 104*b*, as well as a mill train 5. The slab carriages which are positioned in the branch line (Y) are illustrated by dash-dotted lines. A transverse movement of the carriages is illustrated by arrows.

Upon determination of an unsatisfactory surface quality, the respective thin slab portion is moved with the first slab carriage 110 by transverse movement from the production line (X) into the branch line (Y). In the branch line (Y) the exit 116 of the first carriage 110 is aligned with a surface processing complex or device, comprised of a descaling device 109, an inspection device 108, a device for partial cooling 107, and, for example, a grinding device 106, as well as a roller table for longitudinal movement of the thin slab portion parallel to the production line (X). After completion of the surface processing, the respective thin slab portion is returned by means of the second transverse carriage 111 into the production line (X). A homogenization of the temperatures across the slab cross-section in preparation for the rolling process is carried out subsequently in a second part of the roll hearth furnace 104*b*.

If after exiting from the continuous casting device no or allowable surface flaws are detected, the respective slab portion passes, without being moved into the branch line, the conventional sequence of furnace and mill train, wherein the two transverse carriages represent parts of the furnace. in this connection, the gap, which results when moving the respective slab carriage, can be closed by a furnace portion, in a lateral waiting position Z (not shown) that is oppositely arranged, for continuing the process.

Figure 5:
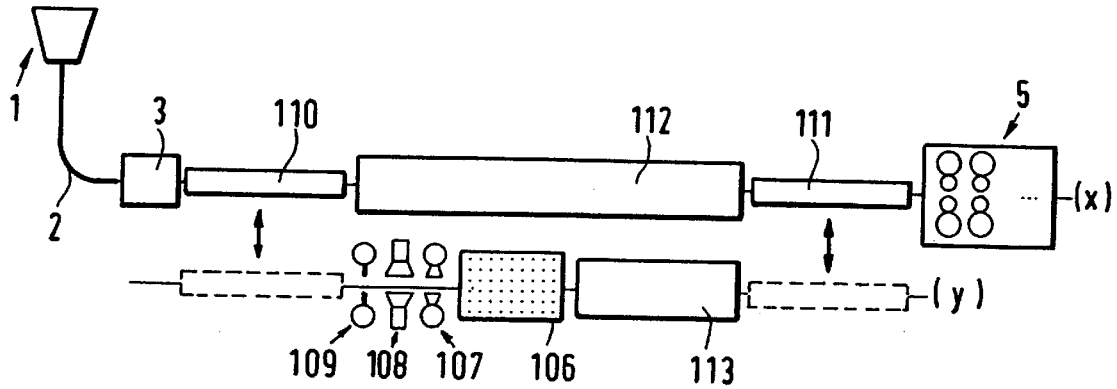
FIG. 5 is a first embodiment of the device according to FIG. 4.

In a further development of the offline version, the second part of the furnace is moved from the production line (X) into the branch line (Y) (FIG. 5). Now the production line (X) is comprised of a transverse separating device 3, a first transverse slab carriage 110, a furnace 112, a second transverse slab carriage 111, and a mill train 5, while the branch line (Y) comprises the movable first carriage (illustrated by dashed lines), the surface processing complex (106 to 109) is subsequently arranged furnace 113, as well as a second movable transverse slab carriage.

Figure 6:
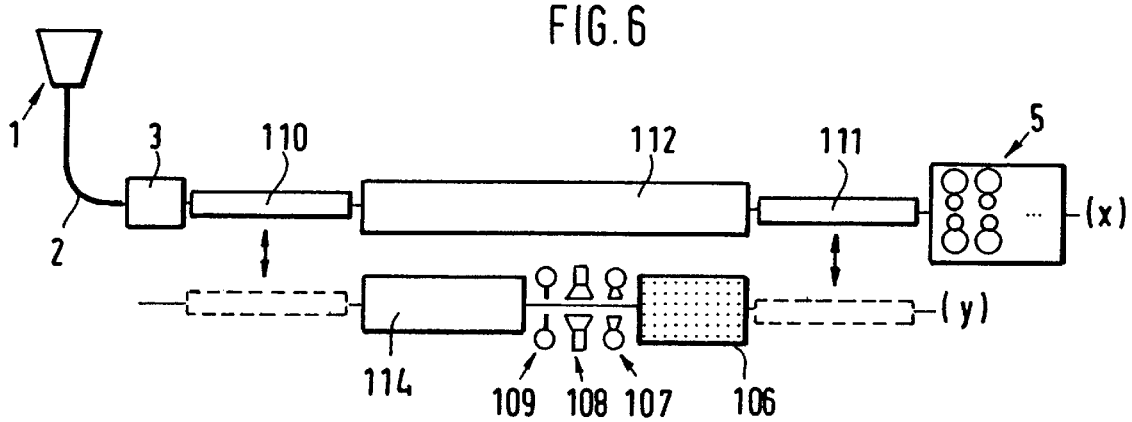
FIG. 6 is a second embodiment of the device according to FIG. 4.

A further embodiment of the arrangement according to FIG. 4 is illustrated in FIG. 6. Here, upstream of the surface processing complex (106 to 109), a buffer furnace 114 is arranged which receives slabs awaiting surface processing and ensures that they essentially do not cool down.

Figure 7:
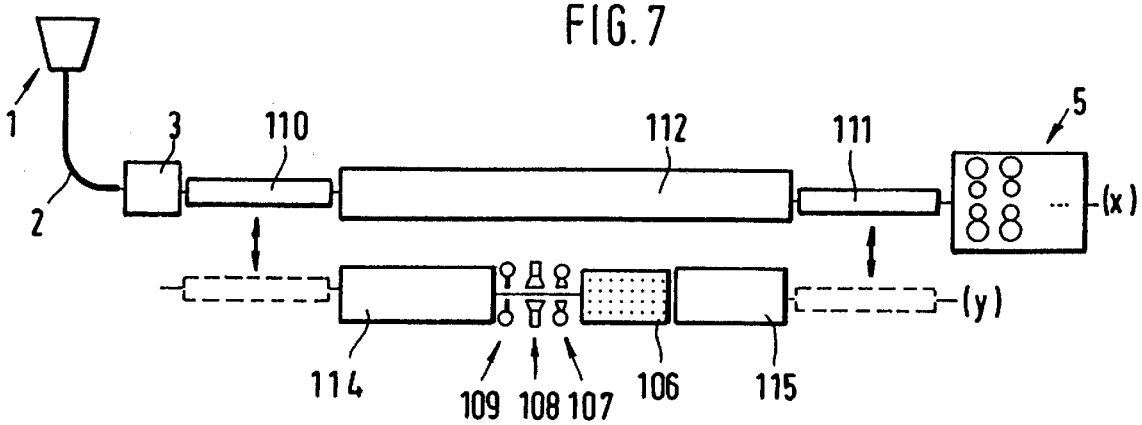
FIG. 7 is a third embodiment of the device according to FIG. 4.

The arrangement, as illustrated in FIG. 7, combines the arrangement parts buffering furnace 114 and heating furnace 115 which, in addition to compensation of the temperatures, also makes possible reheating of the slab portions. It is ensured that the processed slabs, which have been surface cooled in preparation, are returned to a temperature required for rolling, respectively, undergo a temperature homogenization and, after reintroduction of the slab portion back into the production line (X), are then subjected to the rolling process.

Figure 8:
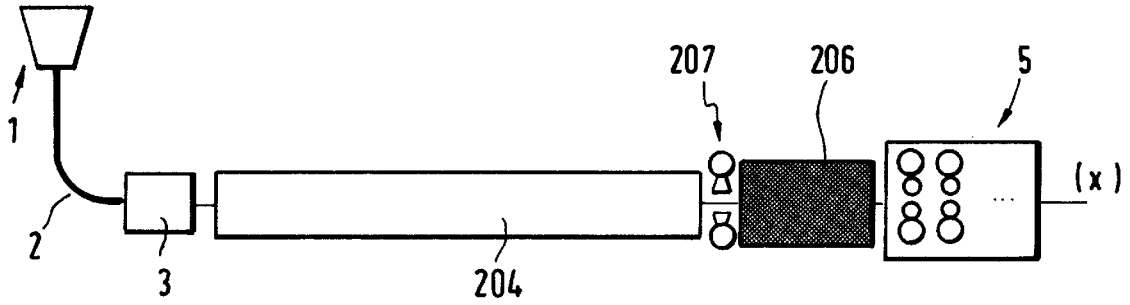
FIG. 8 a side view of an arrangement for producing strips and sheets with the step of partial cooling arranged upstream of the surface treatment within the production line (X), wherein the surface treatment device is arranged downstream of the heating device.

Finally, FIG. 8 shows an embodiment of an arrangement for producing strips and sheets with the step of partial cooling carried out upstream of surface processing within the production line (X), wherein the surface processing device is arranged downstream of the heating device. Downstream of the casting device 1, the production line (X) in this embodiment is comprised of, downstream of the optionally provided separating device 3, of a heating device 204 which is comprised preferably of a roll hearth furnace, a surface treatment device 206 with preceding cooling device 207 as well as a subsequently arranged mill train 5. The slab transport speed is adjusted in this context to the required rolling transport speed. All other embodiments described in FIGS. 2 through 7 can also be used in connection with this arrangement when accordingly adjusted.

Figure 9:
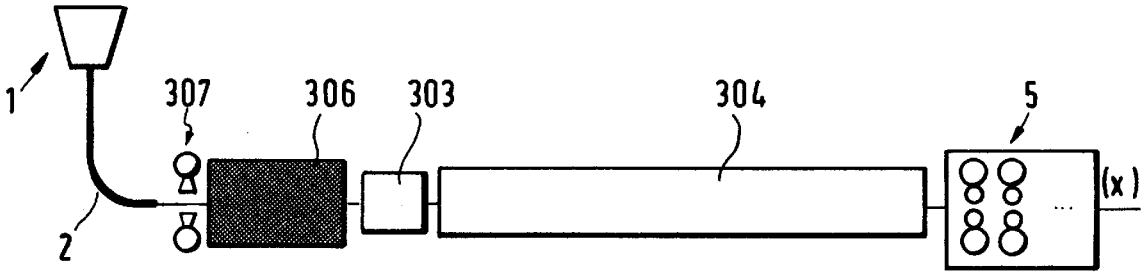
FIG. 9 is a side view of an arrangement for producing strips and sheets with the step of partial cooling arranged upstream of the surface treatment within the production line (X), wherein the transverse separating device is arranged downstream of the surface processing device.

The optionally present transverse separating device, in a preferred embodiment in the form of a pair of shears, is provided either upstream of the device for surface treatment or downstream thereof. FIG. 9 shows an arrangement of the sequentially arranged components casting machine 1, device for partial cooling 307, surface treatment device 306, transverse separating device 303, heating device 304 as well as mill train 5. This embodiment has the advantage with respect to the device for surface treatment processing with transverse separating device arranged upstream thereof that the surface treatment is not performed on the already separated slab portion but is integrated into the continuous process and can thus operate continuously without interruptions and adaptations to the respective slab portion.

While specific embodiments of the invention have been shown and described in detail to illustrate the inventive principles, it will be understood that the invention may be embodied otherwise without departing from such principles.

What is claimed is:

1. A method for surface processing a continuously cast metal product in a hot state of the metal product for the purpose of eliminating surface flaws and surface contaminants, wherein the method comprises the steps of:

performing a surface treatment to eliminate surface flaws and surface contaminants by processing tools; and prior to the step of performing a surface treatment, cooling at least a portion of at least one surface of the metal product for a defined decrease of the temperature of a surface to be treated in order to reduce thermal loading of the processing tools.

2. The method according to claim 1, further comprising the step of inspecting at least one portion of at least one surface of the metal product with respect to surface flaws or surface contaminants before the step of cooling, wherein, based on a result of the inspecting step, the surface treatment is performed only on surface areas found to be defective in the inspecting step.

3. The method according to claim 2, further comprising the step of cleaning at least one surface of the metal product before the inspecting step.

4. The method according to claim 3, wherein the step of cleaning is a descaling process.

5. The method according to claim 1, wherein the surface treatment is selected from the group consisting of grinding, milling, and flame chipping.

6. The method according to claim 1, wherein the step of surface treatment is performed within the production line between a casting process and a rolling process.

7. The method according to claim 1, comprising the steps of transversely cutting the continuously cast metal product into product portions, transversely moving the product portions from the production line into a branch line, longitudinally moving the product portions in the branch line while performing the surface treatment, and transversely returning the product portions from the branch line to the production line.

8. The method according to claim 1, wherein the slab has a thickness of 30 mm to 250 mm.

9. The method according to claim 1, wherein the metal product is stainless and acid-resistant steel.

10. A device for surface processing a continuously cast metal product in a hot state of the metal product for the purpose of eliminating surface flaws and surface contaminants, the device comprising:

a cooling device configured to cool at least a portion of at least one surface of the metal product for a defined decrease of the temperature of a surface to be treated; and a surface treatment device, having processing tools for a surface treatment to eliminate surface flaws and surface contaminants, arranged downstream of the cooling device in a conveying direction of the metal product, wherein thermal loading of the processing tools is reduced by the cooling device.

11. The device according to claim 10, further comprising an inspecting device arranged upstream of the cooling device in the conveying direction of the metal product.

12. The device according to claim 11, further comprising a cleaning device arranged upstream of the inspecting device in the conveying direction of the metal product.

13. The device according to claim 12, wherein the cleaning device is a descaling device.

14. A production arrangement for producing sheets and strips of metal, the arrangement having a production line comprising:

a continuous casting device configured to cast slab;

a heating arrangement comprising at least one of a heating device and a temperature equilibration device arranged downstream of the continuous casting device in a conveying direction of the slab;

a hot mill train arranged downstream of the heating arrangement in the conveying direction of the slab; and a surface processing device comprising a cooling device and a surface treatment device, having processing tools for a surface treatment to eliminate surface flaws and surface contaminants, arranged downstream of the cooling device in the conveying direction of the metal product, wherein the cooling device is configured to cool at least a portion of at least one surface of the metal product for a defined decrease of the temperature of a surface to be treated so that thermal loading of the processing tools is reduced, wherein the surface processing device is arranged between the continuous casting device and the hot mill train.

15. The arrangement according to claim 14, wherein the surface processing device is arranged upstream of the heating arrangement in the conveying direction of the slab.

16. The arrangement according to claim 14, wherein the surface processing device is arranged downstream of the heating arrangement in the conveying direction of the slab.

17. The arrangement according to claim 14, further comprising a transverse cutting device arranged downstream of the continuous casting device in the conveying direction of the slab and configured to cut slab portions from the continuous cast slab.

18. The arrangement according to claim 17, further comprising:

a branch line arranged parallel to the heating arrangement or portions of the heating arrangement; and slab portion carriages configured to move the slab portions from the production line to the branch line and return the slab portions from the branch line to the production line, wherein the slab portion carriages are arranged before and behind the heating arrangement or the portions of the heating arrangement.

19. The arrangement according to claim 18, wherein the branch line further comprises a temperature equilibration furnace or a heating furnace downstream of the surface processing device.

20. The arrangement according to claim 18, wherein the branch line further comprises a buffer furnace arranged upstream of the surface processing device.

* * * * *